United States Patent [19]

Che

[11] 4,357,228

[45] Nov. 2, 1982

[54] RECOVERY OF HYDROCARBON VALUES FROM PYROLYTIC VAPORS

[75] Inventor: Stanley C. Che, Los Alamitos, Calif.

[73] Assignee: Occidental Research Corporation, Irvine, Calif.

[21] Appl. No.: 221,672

[22] Filed: Dec. 30, 1980

[51] Int. Cl.[3] ..... C10G 1/00

[52] U.S. Cl. ..... 208/8 R; 208/8 LE

[58] Field of Search ..... 208/8 R, 8 LE, 8 AT, 208/8 D

[56] References Cited

U.S. PATENT DOCUMENTS

| | | | |
|---|---|---|---|
| 4,030,893 | 6/1977 | Keller | 208/8 LE |
| 4,045,328 | 8/1977 | Green et al. | 208/8 LE |
| 4,060,478 | 11/1977 | Lang | 208/8 LE |
| 4,075,079 | 2/1978 | Lang | 208/8 LE |
| 4,085,030 | 4/1978 | Green et al. | 208/8 R |
| 4,159,238 | 6/1979 | Schmid | 208/8 LE |
| 4,162,959 | 7/1979 | Duraiswamy | 208/8 R |
| 4,166,786 | 9/1979 | Duraiswamy et al. | 208/8 R |
| 4,225,415 | 9/1980 | Mirza et al. | 208/8 R |
| 4,229,185 | 10/1980 | Sass | 208/8 R |
| 4,230,557 | 10/1980 | Bertelsen et al. | 208/8 R |
| 4,260,473 | 4/1981 | Bauer | 208/8 R X |
| 4,263,124 | 4/1981 | Wickstrom et al. | 208/8 R |

*Primary Examiner*—Delbert E. Gantz
*Assistant Examiner*—William G. Wright
*Attorney, Agent, or Firm*—Forrest E. Logan

[57] ABSTRACT

A process for producing light aromatics, intermediate coal liquids, tar acids, and heavy hydrocarbons from pyrolytic vapors produced by the pyrolysis of coal is described herein. Such pyrolytic vapors are contacted with a quench liquid which comprises a hydrogen donor solvent to condense the pyrolytic vapors and form a liquid mixture which comprises pyrolytic condensate. The liquid mixture is separated by vacuum flashing into a vapor containing tar acids and a liquid mixture containing the quench liquid and condensate remainder. This liquid mixture is then heated to transfer hydrogen from the hydrogen donor solvent to the condensate remainder. The hydrogenated liquid mixture is then separated into a heavy hydrocarbon stream and a solvent mixture which contains the spent and unused hydrogen donor solvent.

The vapor produced by the vacuum flashing is then condensed and separated into a liquid stream containing tar acids, and a tar acid raffinate.

A mixture of the solvent mixture and the tar acid raffinate is separated into a liquid stream containing light aromatics, a stream containing intermediate coal liquids, and a stream containing two- and three-ring aromatics and the spent and unused hydrogen donor solvent.

The latter stream is then hydrogenated with gaseous hydrogen to produce two- and three-ring hydroaromatics and a hydrogenated spent hydrogen donor solvent, both of which are operative for recycle as a quench liquid and subsequently as a hydrogen donor solvent in the process.

15 Claims, 5 Drawing Figures

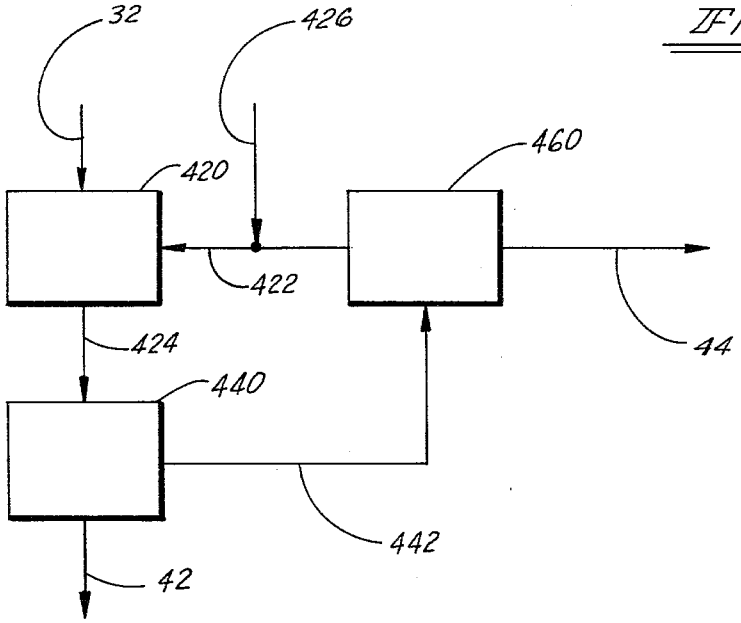
FIG. 2
FIG. 3
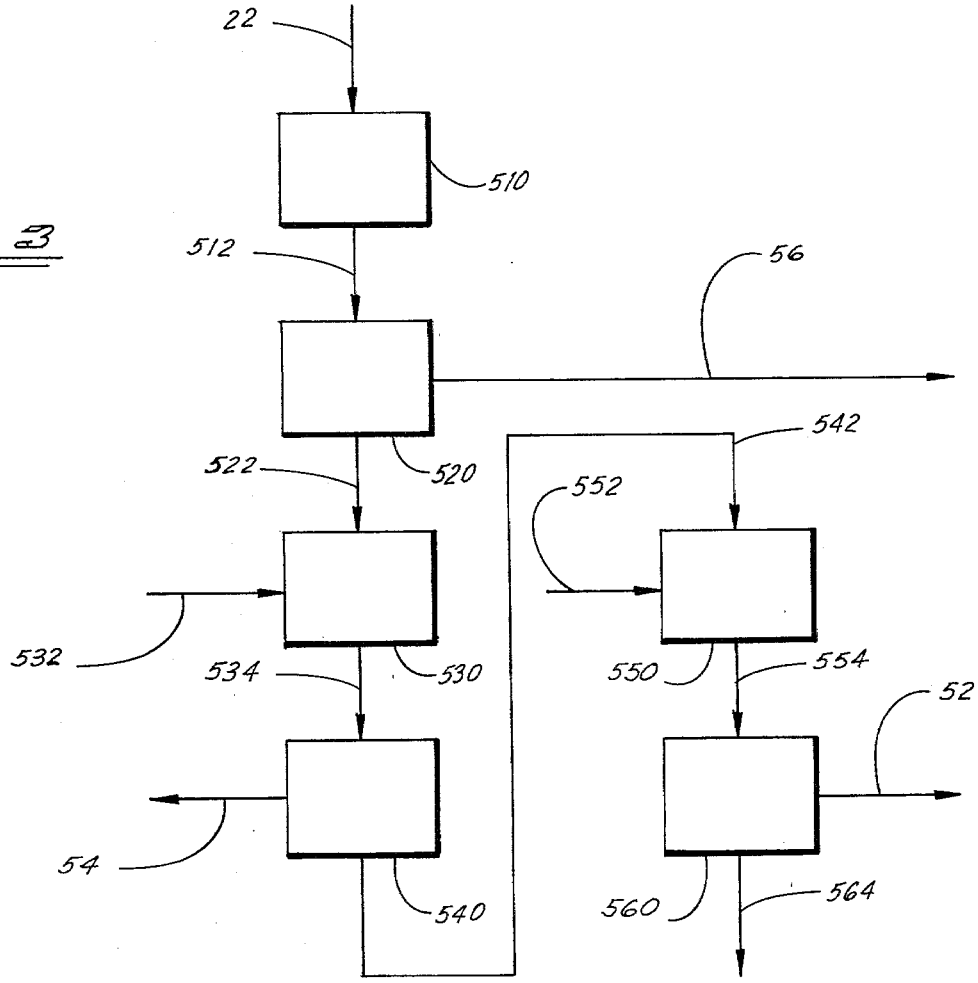

RECOVERY OF HYDROCARBON VALUES FROM PYROLYTIC VAPORS

BACKGROUND OF THE INVENTION

The present invention is directed to improvements in the flash pyrolysis of carbonaceous material.

Fluid fossil fuels, such as oil and natural gas, are becoming scarce as these fuels are consumed by a world whose population is continually growing. As a consequence, considerable attention is being directed toward pyrolyzing coal and other similar solid carbonaceous materials to useful liquid and gaseous hydrocarbon products. Pyrolysis processes vary widely and include transport flash pyrolysis where pyrolysis occurs under turbulent flow conditions.

A problem exists in maximizing the yield of liquid hydrocarbons in molecular weight ranges desirable for conversion to useful end products.

Pyrolysis of coal and similar solid carbonaceous materials can produce a heavy viscous tar liquid. The tar liquid produced can be semi-solid or even solid and can have a very low hydrogen content. For example, the hydrogen-to-carbon ratio of tar liquids produced by pyrolysis of coal can typically be about 1.0.

In the past, in order to produce a marketable product, tar liquids which have been produced by pyrolysis have been hydrogenated by gaseous hydrogen to increase the hydrogen content and to remove some of the hetero atoms. Generally, high pressure gaseous hydrogen and catalysts in the sulfide form of groups VIB and VIII metals impregnated on porous solid support have been used during such hydrogenation processes. In the conventional hydrogenation of viscous tar liquids, the gaseous hydrogen consumption is very high, ranging from about 2500 to about 6000 standard cubic feet (SCF) of hydrogen per barrel of coal tar. Additionally, during conventional hydrogenation processes, the catalyst life is typically low and there is not believed to be a catalyst with proven life of more than about 200 hours of continuous on-stream operation. Generally, the high pressures and temperatures required, i.e., greater than about 2500 psig and about 600° F., make hydrogenation of coal tar economically unattractive.

It is believed that the initial step in pyrolysis of coal is the thermal generation of hydrocarbon free radicals via homolytic bond scission of the coal. These hydrocarbon free radicals can be terminated by hydrogen to produce tar liquids and gas products, or they can combine with each other to produce undesirable heavy molecules such as heavy viscous tars having a boiling point above the boiling point of desirable middle distillate tar liquids. Ultimately, the hydrocarbon free radicals can continue to grow or combine with a carbon site to form char or coke.

A technique that has been used in the past, in addition to hydrogenation of high molecular weight tar liquids produced by pyrolysis, is to upgrade the tar liquids by the addition of gaseous hydrogen to the pyrolysis reactor. By hydrogenating volatilized hydrocarbons in a pyrolysis reaction zone using hydrogen gas, the value of the volatilized hydrocarbons is increased by the removal of the sulfur and nitrogen as hydrogen sulfide and ammonia. Vapor phase hydrogenation in the pyrolysis reactor also reduces the viscosity and lowers the average boiling point of the volatilized hydrocarbons by terminating some hydrocarbon free radicals before they can polymerize to form heavy high molecular weight tar liquids.

Processes involving hydrogenation are disclosed in U.S. Pat. Nos. 4,162,959 and 4,166,786. These patents disclose processes wherein coal, hot carbon-containing residue, and hydrogen gas are combined in a transport flash pyrolysis reaction zone where the coal is pyrolyzed and the pyrolysis products are simultaneously hydrogenated.

The effectiveness of hydrogen gas in terminating hydrocarbon free radicals and in hydrogenation of volatilized hydrocarbons has been found to be directly related to the hydrogen partial pressure in the reactor. The pyrolysis reaction zone of a pyrolysis reactor is preferably operated at pressures slightly greater than ambient, although pressures up to about 10,000 psig may also be used. An increase in pressure increases the hydrogen partial pressure in the pyrolysis zone and thus the effectiveness of the hydrogen in terminating free radicals and in hydrogenation of the volatilized hydrocarbons. Unfortunately, the use of high pressures increases the cost of equipment required and the total cost of the overall operation of pyrolysis. Generally, the preferred operating pressure of the pyrolysis zone, from an economical point of view, is from about 1 to about 1,000 psig, and preferably in the lower range of such pressures. The effective partial pressure of hydrogen at these pressures, however, is low and as a consequence the degree of free radical termination is less than desired.

It is known the polymerization and cracking of tar takes place rapidly at higher temperatures. Generally, vapors from pyrolysis have been condensed using either direct or indirect cooling to minimize the occurrence of secondary reactions involving combination of lighter hydrocarbon molecules into the heavier, less desirable molecules. Condensation by rapid cooling has had some effect on preventing tar from cracking, but is not completely satisfactory in preventing tar liquids from polymerizing by free radical recombination.

Processes in which pyrolytic vapors from the pyrolysis of coal are quenched with a quench fluid are described in U.S. Pat. Nos. 4,225,415 and 4,085,030.

A pyrolysis process is, therefore, desired which substantially eliminates secondary reactions in pyrolysis products and hydrogenates the pyrolysis products using less severe operating conditions, thereby economically enhancing the yield of lower molecular weight coal-derived liquids from the process.

SUMMARY AND DISCLOSURE OF THE INVENTION

This invention is a process for production of liquid hydrocarbons from pyrolytic vapors produced by the pyrolysis of coal. Pyrolytic vapors produced by the pyrolysis of coal have a broad range of molecular weights, boiling points, and hence viscosities which range from very fluid and volatile liquid hydrocarbons such as benzene, to very heavy asphaltenes, preasphaltenes, tars, and pitches. Generally the more aromaticity of the coal and the lower the pyrolysis temperature and time the coal is in the pyrolysis zone at an elevated temperature, the higher will be the molecular weights of the pyrolytic vapors, and the higher will be the boiling points and viscosities of the subsequently formed liquids. Higher molecular weight pyrolysis vapors are both difficult to recover and easily self polymerizable.

It is an object of this invention to facilitate the recovery of pyrolytic vapors from coal and simultaneously prevent or minimize the degree of polymerization normally incurred before the vapors can be condensed and separated into tar acids, light aromatics, intermediate coal liquids, and heavy hydrocarbons. Another object of this invention is to upgrade the quality or amount of the recovered hydrocarbons from such pyrolytic vapors. Still another object is to produce a pyrolytic product which can be easily handled in subsequent processing steps. Still another objective is to increase the H/C ratio and lower the amount of hetero atoms, i.e., oxygen, sulfur, and nitrogen present in the pyrolytic product. Yet another objective is to hydrogenate pyrolytic condensate without the use of high pressure gaseous hydrogen or catalysts.

As the coal-derived liquid is produced from flash pyrolysis, it is homogeneously mixed with a hydrogen donor solvent. The coal-derived liquid is hydrogenated by in-situ hydrogen transfer from hydrogen donor solvent. The spent solvent can then be separated off by distillation, followed by its regeneration to restore its hydrogen donating capability during quenching and in-situ transfer. In this closed loop approach, the hydrogen donor solvent is utilized, during both quenching and product upgrading.

The hydrogen donor solvent is a part of products derived from coal after proper hydrogenation. It consists of, but is not limited to, two-ring hydroaromatics, such as tetrahydronaphthalene and dihydronaphthalene, three-ring hydroaromatics, such as dihydroanthracene and dihydrophenanthrene, and can also comprise phenols such as phenol and cresol and alkyl substituted derivations of the above. The hydroaromatics are hydrogen donating species. The phenols improve the solubility of coal-derived liquid in the hydrogen donor solvent. The alkyl phenol can hydrogenate through alkylation reactions with aromatic rings of coal liquids.

When the hydrogen donor solvent is used as quench solvent for the pyrolytic vapors, it stabilizes the free radicals. The pyrolytic condensate, when mixed with the hydrogen donor solvent, becomes stabilized. The spent solvent, preferably, is a very small fraction due to the high mass ratio of hydrogen donor solvent to pyrolytic vapors; the majority of the hydrogen donor solvent is not used.

Since there is a high concentration of hydrogen donor components in the solution containing the condensate, there is a very high effective hydrogen concentration attained; for example, 1 bbl tetrahydronaphthalene is equivalent to 1850 SCF available hydrogen. To reach such high hydrogen concentrations using gaseous hydrogen would require very high gaseous pressures. Furthermore, the hydrogen from hydroaromatic components is more reactive than gaseous hydrogen. Therefore, the hydrogenation reaction of this invention can take place at lower temperatures than normally required for catalytic hydrogenation of coal tar. To utilize this process the matrix solution is heated above the threshold temperature that hydrogen from hydroaromatics, or hydrogen donor solvent, becomes disassociated from its ring. This disassociated hydrogen will attack aromatic rings of coal-derived liquids resulting in hydrogenation. When such disassociated hydrogen attacks hetero atoms of coal liquids, hydro-removal of hetero atoms takes place. If the threshold temperature for in-situ hydrogen transfer is lower than the thermal cracking temperature, then there is an added advantage in that very little gas and no coke will be formed. As a result, high selectivity of hydrogen usage is achieved.

If hydrotreating catalyst is used, more selective hydrogenation or hetero atom removals can be achieved.

Since the hydrogen donor solvent contains phenols, it is necessary that phenols are separated from the solution before the hydrogenation. If the phenols are not removed, some of the hydrogen will react with phenols instead of coal-derived liquids. Optionally, the phenols are added back to the hydrogen donor solvent after regeneration.

In general, in this invention pyrolytic vapors produced from the pyrolysis of coal are intimately contacted and quenched in a quench zone with a quench liquid comprising a hydrogen donor solvent under conditions of temperature and time and ratio of quench liquid to pyrolytic vapors operative for forming a first liquid mixture comprising the hydrogen donor solvent and a pyrolytic condensate formed from the pyrolytic vapors by condensation thereof. The pyrolytic condensate comprises tar acids such as phenols and a condensate remainder. The term "phenols" is meant to include "cresols". In one preferred embodiment of this invention the quench liquid is at least about 50 percent by weight hydrogen donor solvent. In another preferred embodiment the ratio of hydrogen donor solvent in the quench liquid to pyrolytic vapors is between about 10 and about 50 on a weight basis. In still another embodiment the quench liquid comprises at least about 50 percent by weight two- and three-ring hydroaromatics, and in an especially preferred embodiment 80 percent.

Hydrogen donor solvents are those solvents which can donate hydrogen to tar free radicals to prevent recombination or polymerization of tar liquids by free radical mechanisms in the vapor or liquid state. Examples of hydrogen donor solvents are hydroaromatic compounds, such as tetrahydronaphthalene, dihydronaphthalene, partially hydrogenated phenanthrenes, partially hydrogenated anthracenes, alkyl substituted compounds of the above, mixtures thereof, and the like, which comprise multi-ring structures wherein one of the rings is aromatic. Hydroaromatic compounds are the preferred hydrogen donor solvents. Tetrahydronaphthalene and dihydrophenanthrene are especially preferred in one embodiment. Hydrogen donor solvents can also be free radical trapping agents, such as thiols, phenols, and amines.

In one embodiment which is especially preferred, the hydrogen donor solvent is produced from the pyrolytic vapors.

Quenching with a quench liquid comprising a hydrogen donor solvent will prevent cracking and polymerization of the pyrolytic vapors, and after condensation, polymerization of the pyrolytic condensate. In general the hydrogen donor solvent has good solubility for the pyrolytic condensate and is preferably mostly aromatic.

Pyrolytic condensate produced by the quenching process is separated by vacuum flashing in a vaccum flashing zone into at least a first vapor which comprises at least a major part of the tar acids, and a second liquid mixture which comprises at least a major part of the quench liquid and the hydrogen donor solvent, and also at least a major part of the condensate remainder. Preferably the vacuum flashing process is conducted so that the about 450° F. and less, normal boiling point, components which comprise the aforementioned tar acids, in the pyrolytic condensate, such as phenols, benzenes, toluenes, xylenes, and other 6- to 10-carbon atom components are flashed.

The condensate remainder in the second liquid mixture is then hydrogenated in a first hydrogenation zone with the hydrogen donor solvent which is present in the second liquid mixture. This is accomplished by heating and holding the second liquid mixture under conditions of elevated temperature and time operative to transfer hydrogen from the hydrogen donor solvent to the condensate remainder in the second liquid mixture. A third liquid mixture is thereby formed which comprises a spent hydrogen donor solvent, unused hydrogen donor solvent, and a hydrogenated condensate remainder. In general, the thusly described in situ hydrogenation of the condensate remainder must be above the threshold temperature for such hydrogen transfer, which is about 650° F. At least about 3 minutes residence time at the elevated temperature is necessary to effect hydrogen transfer. Longer residence times and higher temperatures can, of course, be used and in fact are preferable in the embodiment of this invention wherein it is desirable to obtain the maximum hydrogenation of the condensate remainder. If desired the hydrogenation can be conducted in the presence of a catalyst.

The third mixture from the first hydrogenation zone, which contains the condensate remainder, is separated in a first separation zone into at least a heavy hydrocarbon raffinate which comprises at least a major part of heavy hydrocarbons contained in the hydrogenated condensate remainder, and into a fourth liquid mixture comprising at least a major part of the spent hydrogen donor solvent, the unused hydrogen donor solvent, and a residue of the hydrogenated condensate remainder. Preferably the separation is conducted by extraction, for example by toluene extraction. In such an extraction the toluene insoluble material, which is of course coal-derived material, is the preasphaltenes. The heavy hydrocarbon raffinate which comprises at least a major part of the heavy hydrocarbons, therefore, comprises in this embodiment the preasphaltenes. Regardless of the separating technique employed, the heavy hydrocarbon raffinate is useful as a fuel oil. Further upgrading of the heavy hydrocarbon raffinate, of course, can be conducted, as by hydrogenation, hydrocracking, or coking, if desired.

The first vapor from the vacuum flashing zone, which contains the tar acids, is then condensed and separated in a second separation zone into a fifth liquid mixture which comprises at least a major part of the tar acids, that is, phenols, and a sixth liquid mixture which comprises a tar acid raffinate.

The fourth liquid mixture from the first separation zone, which comprises spent and unused hydrogen donor solvent and the residue of the hydrogenated condensate remainder, is introduced into a third separation zone along with the sixth liquid mixture from the second separation zone which comprises the tar acid raffinate. These liquid mixtures are then separated in the third separation zone into, and forming, at least a seventh liquid mixture which comprises at least a major part of light hydrocarbons contained in the residue of the hydrogenated condensate remainder and the tar acid raffinate; an eighth liquid mixture comprising at least a major part of intermediate coal liquids contained in the residue of the hydrogenated condensate remainder and the tar acid raffinate; and a ninth liquid mixture which comprises at least a major part of two- and three-ring aromatics which are contained in the residue of the hydrogenated condensate remainder and the tar acid raffinate. The ninth liquid mixture also comprises at least the major part of the spent and unused hydrogen donor solvent which was contained in the fourth liquid mixture. Preferably the separation is conducted by distillation. In particular it is preferred that the distillation is conducted in a distillation column such that the top of the column is operated at a pressure of about 100 mm Hg to separate and form the seventh liquid mixture which comprises light aromatics. In this preferred embodiment, the bottom of the column is operated at a pressure of about 20 mm Hg to separate and form the eighth liquid mixture which comprises the intermediate coal liquids. The ninth liquid mixture, which comprises two- and three-ring aromatics, and the spent and unused hydrogen donor solvent which was contained in the fourth mixture, is obtained from the about 500° F. to about 700° F. temperature section of the distillation column. Preferably the intermediate coal liquids comprise hydrocarbons having a normal boiling point range from about 500° F. to about 1000° F. Frequently such intermediate coal liquids comprise aromatic hydrocarbons, aromatic oxygenates, aromatic dioxygenates, aromatic tri- and higher oxygenates, aromatic sulfur compounds, some saturated hydrocarbons, and mixed hetero compounds. Frequently such materials are the asphaltenes which are nominally heptane insoluble but toluene soluble.

The ninth liquid mixture from the third separation zone is hydrotreated in a second hydrogenation zone with a gas comprising gaseous hydrogen under conditions operative to produce a tenth liquid mixture comprising two- and three-ring hydroaromatics, and a hydrogenated spent hydrogen donor solvent. Both the two- and three-ring hydroaromatics and the hydrogenated spent hydrogen donor solvent are operative for use in the quench zone as a quench liquid, and subsequently in the first hydrogenation zone as a hydrogen donor solvent. The tenth liquid mixture also comprises unused hydrogen donor solvent. If desired the hydrogenation can be conducted in the presence of a catalyst.

The tenth liquid mixture from the second hydrogenation zone is then utilized as at least a major part of the quench liquid which comprises a hydrogen donor solvent used in the quench zone for condensing additional pyrolytic vapors formed by the pyrolysis of coal. Therefore, it is to be noted that the hydrotreating of the ninth liquid mixture produces additional hydrogen donor solvent, which is either the same as the original hydrogen donor solvent or equivalent thereto, thereby preventing a continuing depletion of the hydrogen donor solvent in the process caused by the beneficial continual hydrogen transfer to the condensate remainder in the second liquid mixture in the first hydrogenation zone.

BRIEF DESCRIPTION OF THE DRAWINGS

These and other features and advantages of the present invention will become better understood with reference to the following description, accompanying drawings and appended claims.

FIG. 2 schematically illustrates the operation of a particular embodiment of the first separation zone.

FIG. 3 schematically illustrates the operation of a particular embodiment of the second and fourth separation zones.

BEST MODE FOR CARRYING OUT THE INVENTION

Figure 1:
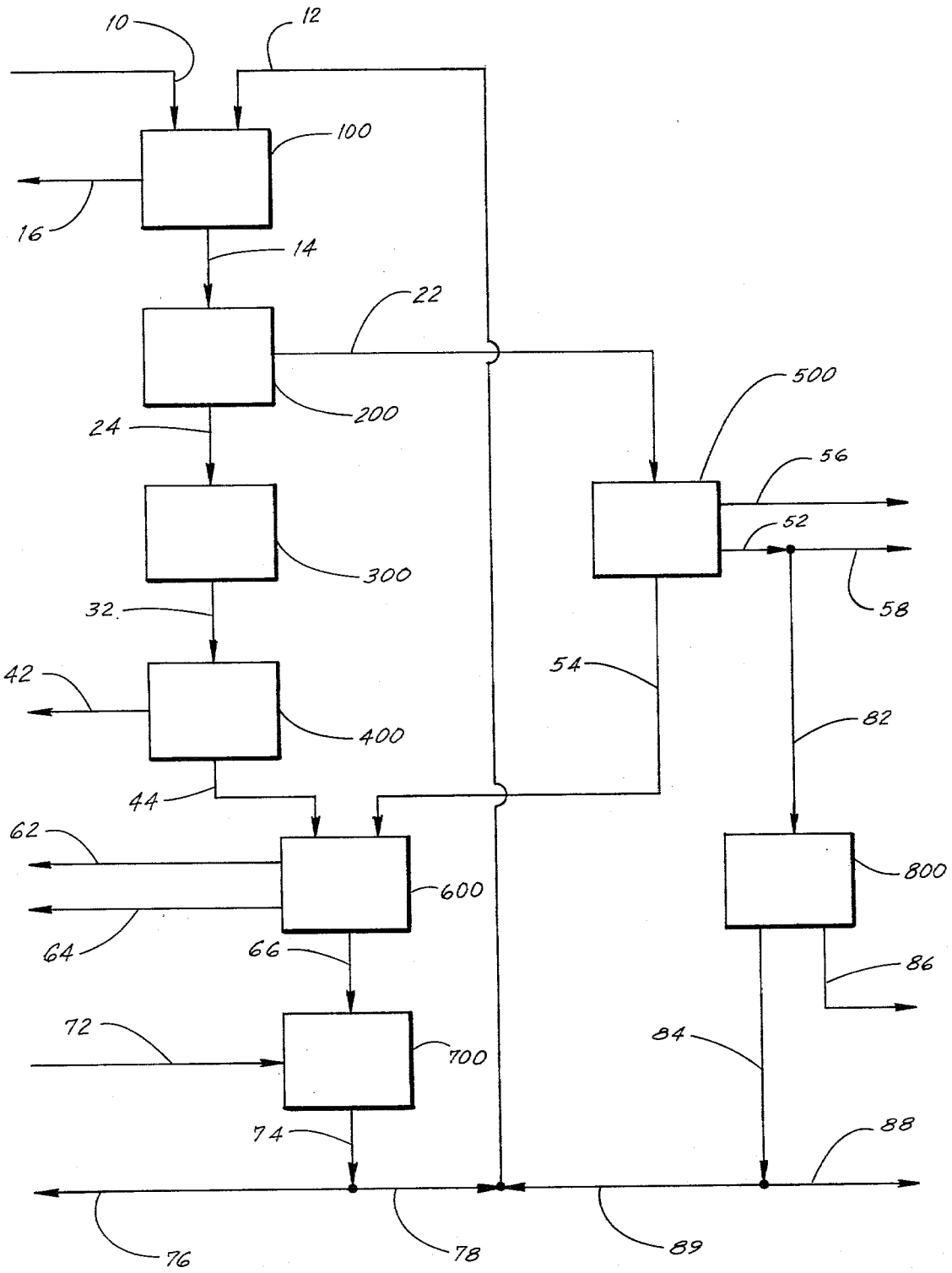
FIG. 1 schematically illustrates the basic overall process of the invention.

With reference to FIG. 1, a stream of pyrolytic vapors, 10, produced from the pyrolysis of coal is introduced into quench zone 100 along with a stream of quench liquid, 12, which comprises a hydrogen donor solvent. Quench zone 100 may be any type of suitable device in which pyrolytic vapors may be contacted with a quench liquid to cause condensation of the pyrolytic vapors, such as, for example, a spray chamber. It is important, however, that the device be of such an arrangement that pyrolytic condensate thusly formed is readily removed from the device by the flow of quench liquid. At least about 50 percent by weight of the quench liquid is hydrogen donor solvent, and at least about 50 percent by weight of the hydrogen donor solvent is two- and three-ring hydroaromatics. The weight ratio of hydrogen donor solvent in quench liquid stream 12 to pyrolytic vapors in stream 10 is about 10.

Pyrolytic condensate formed from the pyrolytic vapors in quench zone 100 comprises tar acids such as phenols and a condensate remainder. By the term "phenols" as used herein is meant any lower molecular weight tar acid such as the chemical phenol, substituted phenols such as cresol, and the like. Non-normally condensable gaseous products are removed from quench zone 100 through stream 16. The non-normally condensable gaseous products usually comprise methane, butane, propane, other low molecular weight hydrocarbons, water vapor, carbon dioxide, and a carrier gas. Such gaseous products are useful as a recycle carrier gas for the pyrolysis system, and also for recovery of its fuel values. A first liquid mixture comprising the pyrolytic condensate and quench liquid is removed from quench zone 100 through stream 14 and introduced into vacuum flash zone 200. Vacuum flash zone 200 is operated at 20 mm Hg and 240° F. to flash off the 450° F. and less, normal boiling point, components which comprise tar acids such as phenols, benzene, toluene and xylene, and other 6- to 10-carbon hydrocarbons. When the pyrolytic vapors are produced by the flash pyrolysis of bituminous coal, then about 10 percent by weight of the feed to vacuum flash zone, stream 14, is flash vaporized and removed as a first vapor in stream 22. The non-flashed material from vacuum flash zone 200 is removed as a second liquid mixture in stream 24. This stream comprises at least a major part of the quench liquid and the hydrogen donor solvent which was introduced into the vacuum flash zone in stream 14.

Stream 24 is then introduced into a first hydrogenation zone 300 to permit the transfer of hydrogen from the hydrogen donor solvent to the condensate remainder. Hydrogenation zone 300 is operated at 700° F. and a few psi gage pressure. It is not necessary to introduce gaseous hydrogen into hydrogenation zone 300 since the condensate remainder will be hydrogenated in situ by the transfer of hydrogen from the hydrogen donor solvent to the condensate remainder. hydrogenating can be conducted in the presence of a catalyst, if desired. Residence time in hydrogenation zone 300 is about 10 minutes. Longer residence times can be employed, if desired, to maximize the transfer of hydrogen to the condensate remainder.

A third liquid mixture stream 32 is removed from hydrogenation zone 300 and introduced into first separation zone 400 for the removal of heavy hydrocarbons. In first separation zone 400, heavy hydrocarbons contained in the hydrogenated condensate remainder are separated from the third liquid mixture, which entered zone 400 as stream 32, and after separation removed from the zone in a heavy hydrocarbon raffinate stream 42. The remaining mixture, containing at least a major part of the spent hydrocarbon donor solvent and the unused hydrogen donor solvent as well as the residue of the hydrogenated condensate remainder, is removed as a fourth liquid mixture in stream 44.

Any type of separation device and process for zone 400 may be used which is suitable for separation of at least the major part of the heavy hydrocarbons contained in the hydrogenated condensate remainder of the third liquid mixture. In one embodiment, FIG. 2, this separation is achieved by an extraction process using toluene as an extractant. FIG. 2 schematically illustrates how first separation zone 400 can be operated. The third liquid mixture in stream 32 is introduced into extraction section 420 of separation zone 400, along with toluene stream 422. The toluene dissolves at least a part of the hydrogenated condensate remainder, as well as the spent and unused hydrogen donor solvent, while leaving undissolved the heavy hydrocarbons contained in the hydrogenated condensate remainder. Toluene extraction section 420 can be operated at 200° F. and at a pressure less than 10 atmospheres gage. The liquid mixture is removed from extraction section 420 in stream 424 and introduced into phase separation section 440 for separation of the insoluble hydrocarbons, i.e., the heavy hydrocarbons, which after separation are removed in heavy hydrocarbon raffinate stream 42. The toluene phase containing the dissolved hydrocarbons is removed from phase separator section 440 in stream 442 and introduced into toluene recovery section 460. The toluene recovery section can be a distillation conducted at about 230° F. to vaporize the toluene and produce a fourth liquid mixture which comprises at least a major part of the spent and unused hydrogen donor solvent and the residue of the hydrogenated condensate remainder. The fourth liquid mixture is removed from section 460 in stream 44. Make-up toluene can be added to the process as required through stream 426. The heavy hydrocarbon raffinate can be used as a fuel oil, if desired, or can be further upgraded to produce additional lighter hydrocarbon products.

Returning to FIG. 1, the first vapor which was produced by vacuum flashing in zone 200 is removed in stream 22 and introduced into a second separation zone, 500. The first vapor is condensed and separated in second separation zone 500, into a fifth liquid mixture comprising at least a major part of the tar acids contained in the first vapor, a sixth liquid mixture whiich comprises a tar acid raffinate, and an aqueous stream comprising at least a major part of the water vapor contained in the first vapor.

The sixth liquid mixture which comprises the tar acid raffinate is removed from second separation zone 500 in stream 54 and introduced into a third separation zone, 600, along with the fourth liquid mixture in stream 44 from first separation zone 400. In the third separation zone, the fourth and sixth liquid mixtures are separated into at least a seventh liquid mixture which comprises at least a major part of the light aromatics contained in the fourth and sixth liquid mixtures, an eighth liquid mixture which comprises at least a major part of the intermediate coal liquids contained in the fourth and sixth liquid mixtures, and a ninth liquid mixture which comprises at least a major part of two- and three-ring aromatics contained in the fourth and sixth liquid mixtures, and at least the major part of the spent and unused hydrogen donor solvent which was contained in the fourth and sixth liquid mixtures. The seventh liquid mixture, which is removed from zone 600 in stream 62, comprises benzene, toluene and xylene, and may also comprise alkyl benzenes, indanes, naphthalene, tetrahydronaphthalene, dihydronaphthalene, furan and thiophene. The eighth liquid mixture, which is removed from zone 600 in stream 64, which comprises at least a major part of the intermediate coal liquids, comprised aromatic hydrocarbons, aromatic oxygenates and aromatic dioxygenates, and may also comprise saturated hydrocarbons, aromatic tri- and higher oxygenates, nitrogenates, aromatic sulfur compounds and mixed hetero compounds. The ninth liquid mixture, which is removed from zone 600 in stream 66, comprises two- and three-ring aromatics, and may also comprise four-ring aromatics, quinoline, or hydroquinone which may be in a partially hydrogenated form.

The separation desired in the third separation zone 600 can be achieved by distillation wherein the top of the distillation column is operated at a pressure of about 100 mm Hg to separate the previously described light aromatics, and the bottom of the column is operated at a pressure of around 20 mm Hg for collection of the intermediate coal liquids, the major part of which have a boiling point between about 500° and about 1000° F. The two- and three-ring aromatics, and the spent and unused hydrogen donor solvent, are obtained from the about 500° to about 700° F. temperature section of the distillation column.

Stream 66, which contains the spent and unused hydrogen donor solvent as well as the two- and three-ring aromatics, is hydrogenated in a second hydrogenation zone, 700, by gaseous hydrogen which is introduced into zone 700 by gas stream 72. Preferably the hydrogenation in zone 700 is conducted in the presence of a suitable catalyst. For example, the hydrogenation can be conducted in the presence of a sulfide nickel-molybdenum catalyst, at about 690° F., and with a residence time of the ninth liquid mixture in the hydrogenation zone of about 15 minutes. A tenth liquid mixture is produced which contains a hydrogenated spent hydrogen donor solvent and two- and three-ring hydroaromatics; both of which are either the same as the original hydrogen donor solvent in the quench liquid or are an equivalent thereto for purposes of quenching and in situ hydrogenation of additional pyrolytic vapors according to the process described herein. In one embodiment the hydrogenation, in zone 700, produces enough hydrogen donor solvent from the spent hydrogen donor solvent and the hydrogenated two- and three-ring aromatics to completely replace the loss in hydrogen transfer capability of the quench liquid as it passes through hydrogenation zone 300; i.e., the difference between the hydrogen transfer capability of stream 24 and stream 32. In this embodiment, therefore, a continuing depletion of the hydrogen donor solvent in the process caused by continual hydrogen transfer to the condensate remainder in first hydrogenation zone 300 is completely compensated by the gaseous hydrogenation occurring in hydrogenation zone 700. In a still further embodiment, enough hydrogen donor solvent is regenerated by the process in zone 700 to completely compensate not only for depletion resulting in the in situ hydrogenation occurring in zone 300, but also to replenish any hydrogen donor solvent lost through system losses such as leaks and waste. Finally, a tenth liquid mixture, which comprises the hydrogenated product, is removed from zone 700 in stream 74 and recycled as the quench liquid to quench zone 100 through streams 78 and 12. Any excess liquid mixture can be withdrawn through draw-off stream 76 if desired.

An optional embodiment of the process provides for the recovery of phenols, or alternatively the chemical phenol, from the tar acids, and mixing of at least a portion of the phenols, or the chemical phenol, with the quench liquid introduced into quench zone 100. As shown in FIG. 1, stream 52 containing the tar acids is divided into stream 58, which is a product recovery stream for tar acids, and stream 82, which is introduced into a fourth separation zone, 800, which is used to separate phenols, or the chemical phenol, from the fifth liquid mixture. As shown in FIG. 1, phenols are removed from separation zone 800 in stream 84, which is then divided into streams 88 and 89. Stream 89 is mixed with the tenth liquid mixture in stream 78, to form quench liquid stream 12. Draw-off stream 88 is used to recover phenols, or the chemical phenol, as a product. Phenol-depleted tar acids are removed from separation zone 800 by stream 86. Separation zone 800 can be another vacuum distillation zone.

Any type of separation device and process for zone 500 may be used which is suitable for separation of at least the major part of the tar acids contained in the first vapor. In one embodiment, FIG. 3, this separation is achieved by condensation, caustic washing, separation of the organic phase and acidification of the aqueous phase, and separation of the tar acids. With reference to FIG. 3, stream 22 containing first vapors from flash zone 200 is introduced into condensation section 510 in which the first vapors are condensed. The condensate is removed from condensation section 510 in stream 512 and introduced into phase separator 520. In phase separator 520, an aqueous phase is separated from the organic phase and removed as stream 56. This stream may contain very small amounts of tar acids such as phenols which can be, if desired, recovered as for example by extraction with ether. The organic phase from separator 520 is removed therefrom in stream 522 and introduced into washing section 530 wherein it is washed and extracted with a solution of 8 to 10 percent sodium hydroxide which is introduced into washing section 530 through stream 532. Washing section 530 is maintained at about 175° F. to keep from forming colloids. Some of the tar acids are dissolved and converted to tar acid salts by the caustic washing. The washed liquid mixture is removed from washing section 530 through stream 534 and introduced into phase separator section 540. An organic phase is removed from section 540 as stream 54 which is the sixth liquid mixture which comprises the tar acid raffinate to be sent to third separation zone 600 of FIG. 1. The tar acid raffinate comprises benzenes and may also comprise indanes and dihydronaphthalenes. The aqueous phase is removed from section 540 through stream 542 and introduced into acidifier section 550 along with carbon dioxide introduced by gaseous stream 552. In acidifier section 550, tar acid salts in the aqueous phase are converted back to their tar acids, and in so doing form an organic phase. An aqueous phase is also formed which contains sodium carbonate. The material in acidifier section 550 is discharged through line 554 into phase separator section 560 for separation of the aqueous and organic phases. The aqueous phase is removed in stream 564, and the organic phase in stream 52. Stream 52, which contains the tar acids, can be divided into draw-off stream 58 for the recovery of tar acids, and a second stream, 82, which, if desired, is sent to the fourth separation zone 800 for the recovery of phenols as shown in FIG. 1. If desired, the organic phase removed from phase separation section 540 can be caustic washed until the tar acid content of the organic phase is reduced to some predetermined value, for example, 0.1 percent or lower.

Although the process has been described as a continuous process, the process can be conducted as a batch process. Storage of the first, second, third or fourth liquid mixture for extended periods of time, for example one month, can be done without polymerization or segregation of the pyrolytic condensate components contained therein because of their solubility in the hydrogen donor solvent.

EXAMPLE NO. 1

This example demonstrates the transfer of hydrogen from a hydrogen donor solvent to coal-derived liquids.

A solution was prepared which contained approximately 7 percent coal-derived liquids and the balance tetrahydronaphthalene as the hydrogen donor solvent. The mixture was thermally treated over glass beads in a continuous reactor operated at a temperature of 750° F. and a few psig pressure. The liquid flow rate was approximately 300 cc/min.

The samples produced in the feed were distilled under vacuum to remove the spent and unused tetrahydronaphthalene. An elemental analysis of the hydrogenated coal-derived liquids resulting from the in situ transfer of hydrogen from the hydrogen donor solvent, i.e., tetrahydronaphthalene, to the coal-derived liquids, as well as the untreated coal-derived liquids, is given in the Table. It is to be noted that the hydrogen-to-carbon ratio is increased over that of the sample which was not treated by the in-situ hydrogenation and that there is a reduction in the hetero atom content.

Figure 4:
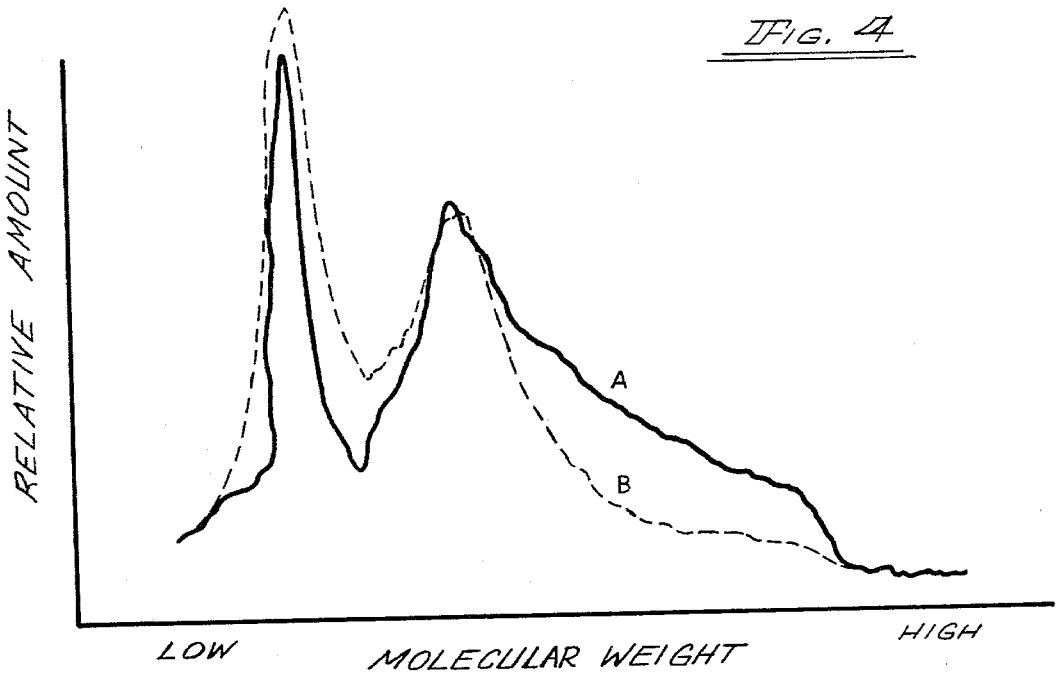
FIGS. 4 and 5 are GPC trace of coal-derived liquids obtained in Example Nos. 1 and 3.

A gel permeation chromatogram, GPC, FIG. 4, which gives the molecular weight distribution profile of the hydrogenated coal-derived liquids, shows a reduction in the amount of higher molecular weight components. The peaks on the left represent residual tetrahydronaphthalene which was not completely removed from the samples by the distillation separation. Chromatogram A is for a coal-derived liquid which was obtained using a tetrahydronaphthalene quench liquid, but without in-situ thermal hydrogenation. Chromatogram B is for the same coal-derived liquid, but with in-situ thermal hydrogenation. In this experiment the equivalent of approximately 1200 scf/bbl of hydrogen was transferred during the in-situ hydrogenation by the hydrogen donor solvent.

EXAMPLE NO. 2

A second run was conducted, under conditions identical to Experiment No. 1, except that the solution contained 3 percent coal-derived liquids and 97 percent tetrahydronaphthalene as the hydrogen donor solvent, and the hydrogenation reaction was conducted at 700° F. and 500 psig of hydrogen gas. The hydrogen flow rate into the reactor was 2 liters per minute.

An elemental analysis of the hydrotreated coal-derived liquids is given in the Table under the column entitled "Example No. 2". Again, it is noted that the hydrogen-to-carbon ratio has been increased and the hetero atom content decreased. In this example the equivalent of approximately 1600 scf/bbl of hydrogen were taken up by the coal-derived liquids.

EXAMPLE NO. 3

Figure 5:
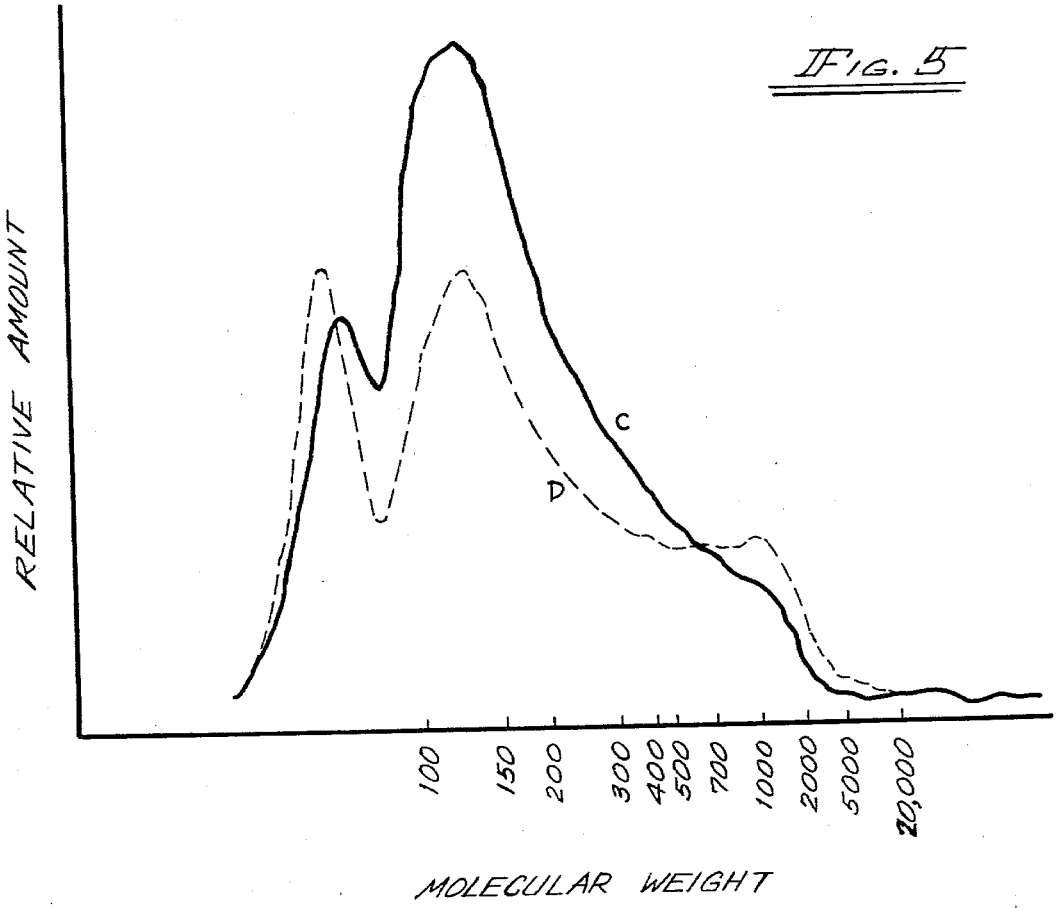

A third solution containing about 24 percent coal-derived liquids and the balance tetrahydronaphthalene, as the hydrogen donor solvent, was placed in an autoclave with a sulfided Ni-Mo catalyst. In-situ hydrotreating was carried out at 690° F., under autogenous pressure for 15 minutes. Both the starting material and the product were vacuum distilled to remove the tetrahydronaphthalene. The residues were analyzed for molecular weight distribution by GPC and the results are shown in FIG. 5. As in FIG. 4, the peaks on the left in FIG. 5 represent residual tetrahydronaphthalene which was not completely removed by the distillation separation. Chromatogram C is for a coal-derived liquid which was obtained using a tetrahydronaphthalene quench liquid, but without in-situ thermal hydrogenation. Chromatogram D is for the same coal-derived liquid, but which in-situ thermal hydrogenation. The GPC of FIG. 5 was calibrated using polystyrene standards.

EXAMPLE NO. 4

A creosote oil was used as a quenching solvent for pyrolytic vapors in a bench scale reactor experiment. The liquid mixture comprising the creosote oil and the pyrolytic condensate was treated at 700° F. for 15 minutes at 500 rpm in an autoclave. The GPC traces of the product and starting material were the same, which proved that no hydrogen transfer occurred from the creosote oil to the coal-derived liquids. Therefore, creosote oil is not a hydrogen donor solvent.

TABLE

| | Weight Percent | | |
|---|---|---|---|
| | Untreated | In-Situ Hydrotreated Coal-Derived Liquids | |
| Element | Coal-Derived Liquids | Example No. 1 | Example No. 2 |
| C | 81.99 | 86.09 | 87.05 |
| H | 6.78 | 8.18 | 8.46 |
| N | 1.25 | 0.56 | 0.50 |
| S | 0.47 | 0.29 | 0.22 |
| O | 9.51 | 4.88 | 3.77 |
| H/C Atomic Ratio | 0.992 | 1.140 | 1.166 |

What is claimed is:

1. A process for producing light aromatics, intermediate coal liquids, tar acids, and heavy hydrocarbons from pyrolytic vapors produced by the pyrolysis of coal comprising:

(a) condensing pyrolytic vapors, formed by the pyrolysis of coal, by contacting said pyrolytic vapors in a quench zone with a quench liquid comprising a hydrogen donor solvent, under predetermined conditions of temperature, time and ratio of quench liquid to pyrolytic vapors operative to form a first liquid mixture comprising said hydrogen donor solvent and a pyrolytic condensate formed from said pyrolytic vapors by condensation thereof, said pyrolytic condensate comprising tar acids and a condensate remainder;

(b) separating said first liquid mixture by vacuum flashing in a vacuum flashing zone into at least a first vapor comprising at least a major part of said tar acids, and a second liquid mixture comprising at least a major part of said quench liquid and said hydrogen donor solvent and also comprising at least a major part of said condensate remainder;

(c) hydrogenating said condensate remainder in said second liquid mixture in a first hydrogenation zone with said hydrogen donor solvent in said second liquid mixture by heating and holding said second liquid mixture under predetermined conditions of elevated temperature and time operative to transfer hydrogen from said hydrogen donor solvent to said condensate remainder in said second liquid mixture thereby forming a third liquid mixture comprising a spent hydrogen donor solvent, unused hydrogen donor solvent and a hydrogenated condensate remainder;

(d) separating said third liquid mixture from step (c) in a first separation zone into at least a heavy hydrocarbon raffinate comprising at least a major part of heavy hydrocarbons contained in said hydrogenated condensate remainder and a fourth liquid mixture comprising at least a major part of said spent hydrogen donor solvent, said unused hydrogen donor solvent, and a residue of said hydrogenated condensate remainder;

(e) condensing and separating said first vapor, from said vacuum flashing zone of step (b), in a second separation zone, into a fifth liquid mixture comprising at least a major part of said tar acids, and a sixth liquid mixture which comprises a tar acid raffinate;

(f) introducing said fourth liquid mixture from said first separation zone of step (d), and said sixth liquid mixture from said second separation zone of step (e), into a third separation zone and separating said fourth and sixth liquid mixtures into, and forming, at least a seventh liquid mixture comprising at least a major part of light aromatics contained in said residue of said hydrogenated condensate remainder and said tar acid raffinate, an eighth liquid mixture comprising at least a major part of intermediate coal liquids contained in said residue of said hydrogenated condensate remainder and said tar acid raffinate, and a ninth liquid mixture comprising at least a major part of two- and three-ring aromatics contained in said residue of said hydrogenated condensate remainder and said tar acid raffinate, and at least the major part of said spent hydrogen donor solvent and unused hydrogen donor solvent contained in said fourth liquid mixture;

(g) hydrotreating said ninth liquid mixture from said third separation zone of step (f), in a second hydrogenation zone with a gas comprising gaseous hydrogen under conditions operative to produce a tenth liquid mixture comprising two- and three-ring hydroaromatics and a hydrogenated spent hydrogen donor solvent, both of which are operative for use in said quench zone as quench liquid and subsequently in said first hydrogenation zone as hydrogen donor solvent, and unused hydrogen donor solvent; and (h) utilizing said tenth liquid mixture from said second hydrogenation zone of step (g) as at least a major part of said quench liquid, which comprises a hydrogen donor solvent, used in said quench zone of step (a).

2. The process of claim 1 wherein the amount of said hydrogen donor solvent in said quench liquid is at least about 50 percent by weight of said quench liquid.

3. The process of claim 1 wherein the ratio of said hydrogen donor solvent in said quench liquid to said pyrolytic vapors is between about 1 and about 50 on a weight basis.

4. The process of claim 1 wherein said hydrogen donor solvent comprises at least about 50 percent by weight two- and three-ring hydroaromatics.

5. The process of claim 1 wherein said hydrogen donor solvent comprises at least about 80 percent by weight two- and three-ring hydroaromatics.

6. The process of claim 1 wherein said vacuum flashing is conducted at about 20 mm Hg and about 240° F. to flash off about 450° F. and less, normal boiling point, hydrocarbons present in said first liquid mixture.

7. The process of claim 1 wherein said elevated temperature in said first hydrogenation zone is at least about 650° F.

8. The process of claim 1 or 7 wherein said hydrogenating of said condensate remainder in said first hydrogenation zone is conducted without the introduction of gaseous hydrogen to said first hydrogenation zone.

9. The process of claim 1 wherein said first separation zone comprises a toluene extraction section and a toluene recovery section, and wherein said separating of said third liquid mixture in said first separation zone comprises extracting said third liquid mixture in said toluene extraction section with toluene at an elevated pressure and temperature operative for extracting, and producing, a toluene phase containing at least the major part of said spent hydrogen donor solvent, said unused hydrogen donor solvent and said residue of said hydrogenated condensate remainder, while said heavy hydrocarbon raffinate comprises at least a major part of said heavy hydrocarbons; separating in said toluene recovery section said toluene from said toluene phase thereby producing said fourth liquid mixture and recovered toluene; and recycling said recovered toluene to said toluene extraction section for extracting additional hydrocarbons.

10. The process of claim 9 wherein said extracting with toluene in said toluene extraction section is conducted at about 250° F. and at a gage pressure less than about 10 atmospheres.

11. The process of claim 1 wherein said condensing and separating said first vapor in said second separation zone comprises condensing said first vapor to form a condensate mixture; extracting said condensate mixture with aqueous caustic soda at an elevated temperature operative for preventing the formation of colloids, and forming sodium tar acid salts and a residual condensate; separating said sodium tar acid salts from the residual condensate; converting the sodium tar acid salts to tar acids; and recovering tar acids.

12. The process of claim 1 or 11 further comprising separating phenols from said tar acids and mixing at least a part of said separated phenols with said tenth liquid mixture before it is utilized as said quench liquid.

13. The process of claim 1 wherein said separating in said third separation zone is by distillation.

14. The process of claim 13 wherein said distillation is conducted in a distillation column, wherein the top of said distillation column is operated at a pressure of about 100 mm Hg to separate and form said seventh liquid mixture which comprises said light aromatics, wherein the bottom of said distillation column is operated at a pressure of about 20 mm Hg to separate and form said eighth liquid mixture which comprises said intermediate coal liquids, and wherein said ninth liquid mixture, which comprises said two- and three-ring aromatics, said spent hydrogen donor solvent and unused hydrogen donor solvent, is obtained from the about 500° to about 700° F. temperature part of said distillation column.

15. A process for producing light aromatics, intermediate coal liquids, phenols, and heavy hydrocarbons from pyrolytic vapors produced by the pyrolysis of coal comprising:

(a) condensing pyrolytic vapors, formed by the pyrolysis of coal, by contacting said pyrolytic vapors in a quench zone with a quench liquid comprising a hydrogen donor solvent, under predetermined conditions of temperature and time operative to form a first liquid mixture comprising said hydrogen donor solvent and a pyrolytic condensate formed from said pyrolytic vapors by condensation thereof, said pyrolytic condensate comprising phenols and a condensate remainder, and wherein the ratio of quench liquid to pyrolytic vapors is between about 1 and about 50 on a weight basis, and wherein said hydrogen donor solvent comprises at least about 50 percent by weight two- and three-ring hydroaromatics;

(b) separating said first liquid mixture by vacuum flashing in a vacuum flashing zone into at least a first vapor comprising at least about 80 percent of the 450° F. and less, normal boiling point, hydrocarbons, which comprises the major part of said phenols in said pyrolytic condensate, and a second liquid mixture comprising at least a major part of said quench liquid and said hydrogen donor solvent and also comprising at least a major part of said condensate remainder;

(c) hydrogenating said condensate remainder in said second liquid mixture in a first hydrogenation zone with said hydrogen donor solvent in said second liquid mixture by heating and holding said second liquid mixture under predetermined conditions of elevated temperature and time operative to transfer hydrogen from said hydrogen donor solvent to said condensate remainder in said second liquid mixture thereby forming a third liquid mixture comprising a spent hydrogen donor solvent, unused hydrogen donor solvent and a hydrogenated condensate remainder, wherein said elevated temperature is at least about 650° F. and said time is at least about three minutes;

(d) separating said third liquid mixture from step (c) in a first separation zone by extraction into at least a heavy hydrocarbon raffinate comprising at least a major part of heavy hydrocarbons contained in said hydrogenated condensate remainder and a fourth liquid mixture comprising at least a major part of said spent hydrogen donor solvent, said unused hydrogen donor solvent, and a residue of said hydrogenated condensate remainder, wherein said heavy hydrocarbons have a normal boiling point of at least about 1000° F.;

(e) condensing said first vapor, from said vacuum flashing zone of step (b) in a condensation section of a second separation zone to form a tar acid condensate, and separating said tar acid condensate by extraction in an extraction section of said second separation zone into a fifth liquid mixture comprising at least a major part of said phenols, and a sixth liquid mixture which comprises a tar acid raffinate;

(f) introducing said fourth liquid mixture from said first separation zone of step (d) and said sixth liquid mixture from said extraction section of step (e) into a third separation zone and separating by distillation said fourth and sixth liquid mixtures into, and forming, at least a seventh liquid mixture comprising at least a major part of light aromatics contained in said residue of said hydrogenated condensate remainder and said tar acid raffinate, an eighth liquid mixture comprising at least a major part of intermediate coal liquids contained in said residue of said hydrogenated condensate remainder and said tar acid raffinate, and a ninth liquid mixture comprising at least a (d) separating said third liquid mixture from step (c) in a first separation zone by extraction into at least a heavy hydrocarbon raffinate comprising at least a major part of heavy hydrocarbons contained in said hydrogenated condensate remainder and a fourth liquid mixture comprising at least a major part of said spent hydrogen donor solvent, said unused hydrogen donor solvent, and a residue of said hydrogenated condensate remainder, wherein said heavy hydrocarbons have a normal boiling point of at least about 1000° F.;

(e) condensing said first vapor, from said vacuum flashing zone of step (b) in a condensation section of a second separation zone to form an acid condensate, and separating said acid condensate by extraction in an extraction section of said second separation zone into a fifth liquid mixture comprising at least a major part of said phenols and cresols, and a sixth liquid mixture which comprises a tar acid raffinate;

(f) introducing said fourth liquid mixture from said first separation zone of step (d) and said sixth liquid mixture from said extraction section of step (e) into a third separation zone and separating by distillation said fourth and sixth liquid mixtures into, and forming, at least a seventh liquid mixture comprising at least a major part of light aromatics contained in said residue of said hydrogenated condensate remainder and said tar acid raffinate, an eighth liquid mixture comprising at least a major part of intermediate coal liquids contained in said residue of said hydrogenated condensate remainder and said tar acid raffinate, and a ninth liquid mixture comprising at least a major part of two- and three-ring aromatics contained in said residue of said hydrogenated condensate remainder and said tar acid raffinate, and at least the major part of said spent hydrogen donor solvent and said unused hydrogen donor solvent contained in said fourth mixture, wherein said light aromatics comprise benzene, toluene and xylene, and wherein said intermediate coal liquids comprise mainly hydrocarbons having normal boiling points of from about 500° to about 1000° F.;

(g) hydrotreating said ninth liquid mixture from said third separation zone of step (f), in a second hydrogenation zone with a gas comprising gaseous hydrogen under conditions operative to produce a tenth liquid mixture comprising two- and three-ring hydroaromatics and a hydrogenated spent hydrogen donor solvent, both of which are operative for use in said quench zone as quench liquid and subsequently in said first hydrogenation zone as hydrogen donor solvent, and unused hydrogen donor solvent;

(h) separating phenols from said fifth liquid mixture from said extraction section of step (e) and mixing at least a part of said separated phenols in a mixing zone with said tenth liquid mixture from step (g) to form a phenol-enriched tenth liquid mixture; and (i) utilizing said phenol-enriched tenth liquid mixture from said mixing zone of step (h) as at least a major part of said quench liquid, which comprises a hydrogen donor solvent, used in said quench zone of step (a).

* * * * *